US005620140A

United States Patent [19]

Utter

[11] Patent Number: 5,620,140

[45] Date of Patent: Apr. 15, 1997

[54] PORTABLE MIST COOLING DEVICE

[76] Inventor: Steven M. Utter, 481 N. Longmore St., Chandler, Ariz. 85224

[21] Appl. No.: 664,302

[22] Filed: Jun. 10, 1996

Related U.S. Application Data

[63] Continuation of Ser. No. 324,872, Oct. 18, 1994, abandoned, which is a continuation-in-part of Ser. No. 927,231, Aug. 7, 1992, Pat. No. 5,535,951.

[51] Int. Cl.[6] ..... B05B 9/08

[52] U.S. Cl. ..... 239/153; 239/373; 239/588

[58] Field of Search ..... 239/152–154, 239/289, 372, 337, 333, 373, 588; 222/79, 175; 4/602, 603, 615–618

[56] References Cited

U.S. PATENT DOCUMENTS

| | | | |
|---|---|---|---|
| 638,207 | 11/1899 | Rice | 239/531 |
| 803,661 | 11/1905 | Brandt . | |
| 876,453 | 1/1908 | Heard . | |
| 1,042,627 | 10/1912 | Watson . | |
| 1,382,397 | 6/1921 | Whitehouse . | |
| 1,731,767 | 10/1929 | Cramer . | |
| 2,083,039 | 6/1937 | Searls . | |
| 2,684,787 | 7/1954 | Charpiat . | |
| 2,735,589 | 2/1956 | Milster . | |
| 2,744,662 | 5/1956 | Smith et al. . | |
| 2,865,541 | 12/1958 | Hicks . | |
| 2,911,157 | 11/1959 | Converse . | |
| 2,924,359 | 2/1960 | Beremand . | |
| 3,018,970 | 1/1962 | Wittenberg et al. . | |
| 3,107,069 | 10/1963 | Draim . | |
| 3,116,856 | 1/1964 | Prussin et al. . | |
| 3,174,658 | 3/1965 | Wittenberg . | |
| 3,184,113 | 5/1965 | Curtis . | |
| 3,190,562 | 6/1965 | Atwood et al. . | |
| 3,228,558 | 1/1966 | Doyle et al. . | |
| 3,352,364 | 11/1967 | DeCoste . | |
| 3,421,697 | 1/1969 | Marks . | |
| 3,450,163 | 6/1969 | Mercier et al. . | |
| 3,469,578 | 9/1969 | Bierman . | |
| 3,524,475 | 8/1970 | Kirk, Jr. . | |
| 3,539,110 | 11/1970 | Kobayashi . | |
| 3,802,511 | 4/1974 | Good, Jr. . | |
| 3,993,245 | 11/1976 | Smith . | |
| 4,043,510 | 8/1977 | Morris . | |
| 4,048,994 | 9/1977 | Lo . | |
| 4,067,485 | 1/1978 | Soin . | |
| 4,120,425 | 10/1978 | Bethurum . | |
| 4,206,877 | 6/1980 | Hoza, III . | |
| 4,328,843 | 5/1982 | Fujii . | |
| 4,407,454 | 10/1983 | Massey . | |
| 4,458,830 | 7/1984 | Werding . | |
| 4,526,298 | 7/1985 | Boxer et al. . | |
| 4,651,903 | 3/1987 | Pagliai . | |
| 4,688,643 | 8/1987 | Carter et al. . | |
| 4,721,250 | 1/1988 | Kennedy et al. . | |
| 4,807,813 | 2/1989 | Coleman | 222/175 X |
| 4,836,409 | 6/1989 | Lane . | |
| 4,867,344 | 9/1989 | Bitterly . | |
| 4,875,508 | 10/1989 | Burke, II et al. . | |
| 5,060,833 | 10/1991 | Edison et al. | 222/175 X |
| 5,069,363 | 12/1991 | Daimler . | |
| 5,104,016 | 4/1992 | Runkel | 222/175 X |
| 5,141,462 | 8/1992 | Latzel | 222/79 X |
| 5,150,819 | 9/1992 | Johnson et al. | 222/79 |
| 5,154,324 | 10/1992 | Stratford . | |
| 5,158,212 | 10/1992 | Sirhan . | |

FOREIGN PATENT DOCUMENTS

| | | | |
|---|---|---|---|
| 41354 | 12/1929 | Denmark | 4/616 |
| 1164746 | 10/1958 | France | 239/154 |
| 754269 | 11/1993 | France . | |
| 1912328 | 5/1970 | Germany . | |
| 387374 | 5/1965 | Switzerland . | |

*Primary Examiner*—Kevin Weldon

*Attorney, Agent, or Firm*—Fulwider Patton Lee & Utecht, LLP

[57] ABSTRACT

An apparatus for delivering a fine spray mist for evaporatively or conductively cooling a localized area. The apparatus consists of a pressurizable container, a valve for activating the release of fluid from he container, a spray nozzle or a plurality of spray nozzles coupled to the valve, a pump for pressurizing the container, a belt for securing the device to a person, and a clip for attaching the mist nozzle in such a fashion that it directs the flow of mist in a hands free manner.

16 Claims, 2 Drawing Sheets

FIG. 1
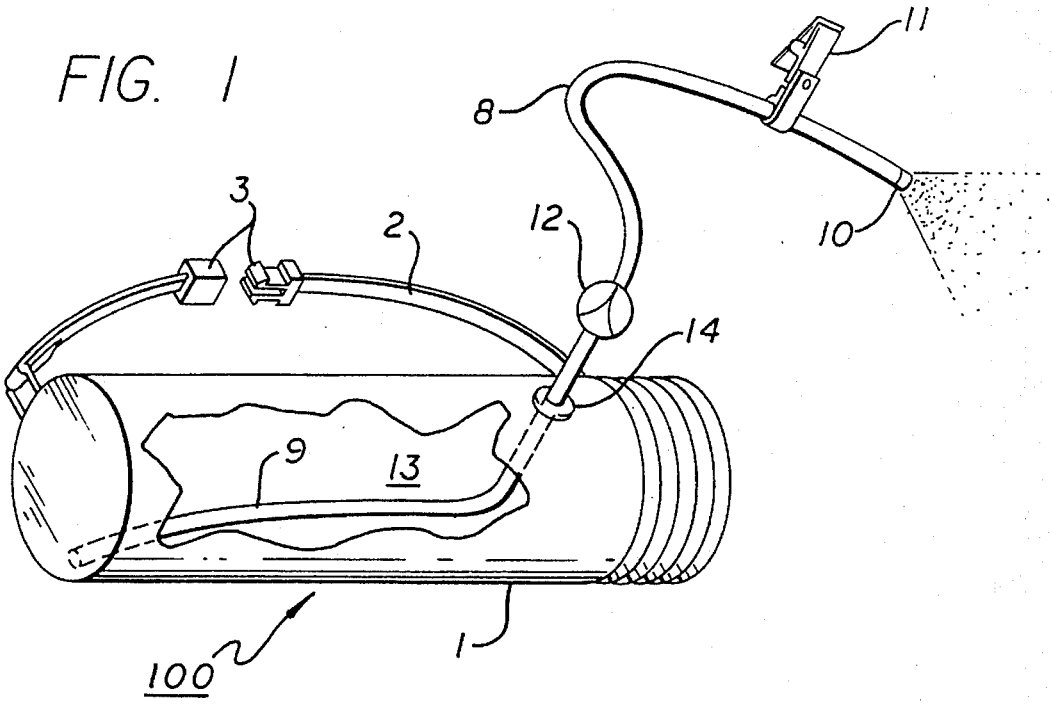
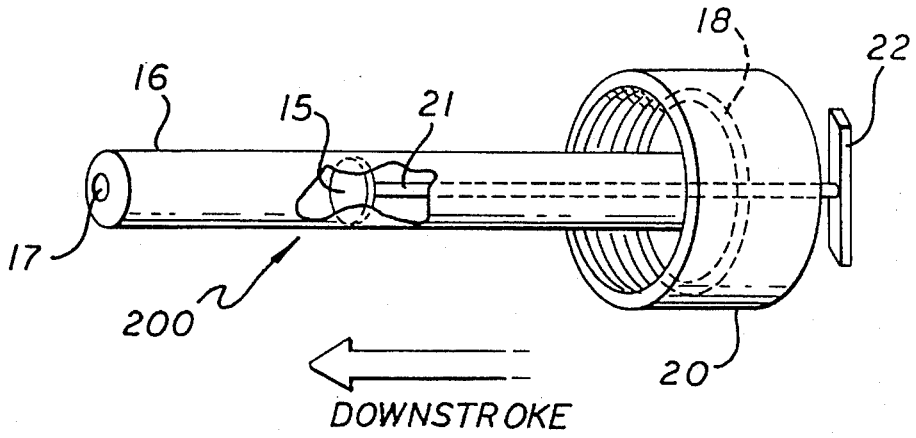
FIG. 2

PORTABLE MIST COOLING DEVICE

This application is a continuation, of application Ser. No. 08/324,872, filed Oct. 18, 1994, now abandoned, which is a continuation-in-part of application(s) Ser. No. 07/927,231 filed on Aug. 7, 1992 now U.S. Pat. No. 5,535,951.

BACKGROUND OF THE INVENTION

The previous deice introduced a fine mist into the dry air to lower ambient temperature. The previous device supplied the mist by means of a continuously pressurized tank.

The current invention delivers a fine mist spray to cool a localized area by evaporative cooling also, but with the following improvements:

The new device allows for the introduction of ICE or ice water allowing the device to work efficiently in humid environments through the process of conductive cooling as well as evaporative cooling in dry climates. The new device also incorporates a hand pump which allows the device to be filed in a remote location. According to the preferred embodiment of the device, the pressurizable tank may be of sufficient size and in acceptable packaging to make the entire apparatus portable by hand carrying, adapted to be worn in a back-pack or fanny pack configuration or be substantially free standing.

The only known portable spraying device for delivering humidity into a dry atmosphere is my previous invention. Other devices known in the spraying apparatus art area variety of devices for directing and applying a spray of fluid to an object, such as crops lawns, weeds, or fire. Generally, these devices may be broadly classified into two categories. The first group, consisting of motor driven sprayers, is represented by U.S. Pat. Nos. 3,421,697 issued to Marks on Jan. 14, 1969, 3,539,110 issued to Kobayashi on Nov. 10, 1970, 3,802,511 issued to Good, Jr. on Apr. 9, 1974 and 4,651,903 issued to Pagliai on Mar. 24, 1987. This first group of patents broadly discloses portable back-pack like sprayers, however none discloses a fannypack style that can be worn for hands free operation. The second group, consisting of non-motor driven sprayers, is represented by U.S. Pat. Nos. 2,911,157 issued to Converse on Nov. 3, 1959, 3,352,364 issued to De Coste on Nov. 14, 1967, 3,993,245 issued to Smith on Nov. 23, 1976, and 4,688,643 issued to a Carter et al on Apr. 25, 1987. Of this second group, only patents issued to Coste and Smith disclose a sprayer having a pressurizable container and a spray nozzle. In the De Coste patent, the fluid in the container is directly pressurized by introduction of pressurized air through an air valve into the fluid container. Upon exhaustion of the air pressure within the container, the container must be re-pressurized from a pressurized air source. The Smith patent discloses a spraying device having a pressurizable container where a manual air-pump is used to prssurize the fluid the container. My previous invention discloses a pressurizable container but can be substantially improved by including a manual air pump to pressurize the fluid in the container.

Thus, an examination of the art, reveals that there is no known spray cooling apparatus for evaporatively cooling a localized area which employs a pressuriable container a valve for activating a flow of pressurized fluid from the tank through a nozzle or a plurality of nozzles and a fanny pack style bag for wearing the device in a hands free operative style, and allowing for the introduction of ice cubes and or ice water.

SUMMARY OF THE INVENTION

Accordingly, it is a broad aspect of the present invention to provide a misting apparatus which utilizes a tank container such as that described in U.S. Pat. No. 3,993,245 having a pressurizable container having a manual air-pump to pressurize the fluid within the container, a valve for activating the flow of prssurized fluid through a nozzle or plurality of nozzles.

BRIEF DESCRIPTION OF THE FIGURES

FIG. 1 is a perspective partial cross sectional view of the misting apparatus of the present invention.

FIG. 2 is a partial cross sectional view of ther pump and cap assembly.

DESCRIPTION OF THE PREFERRED EMBODIMENTS OF THE INVENTION

Figure 3:
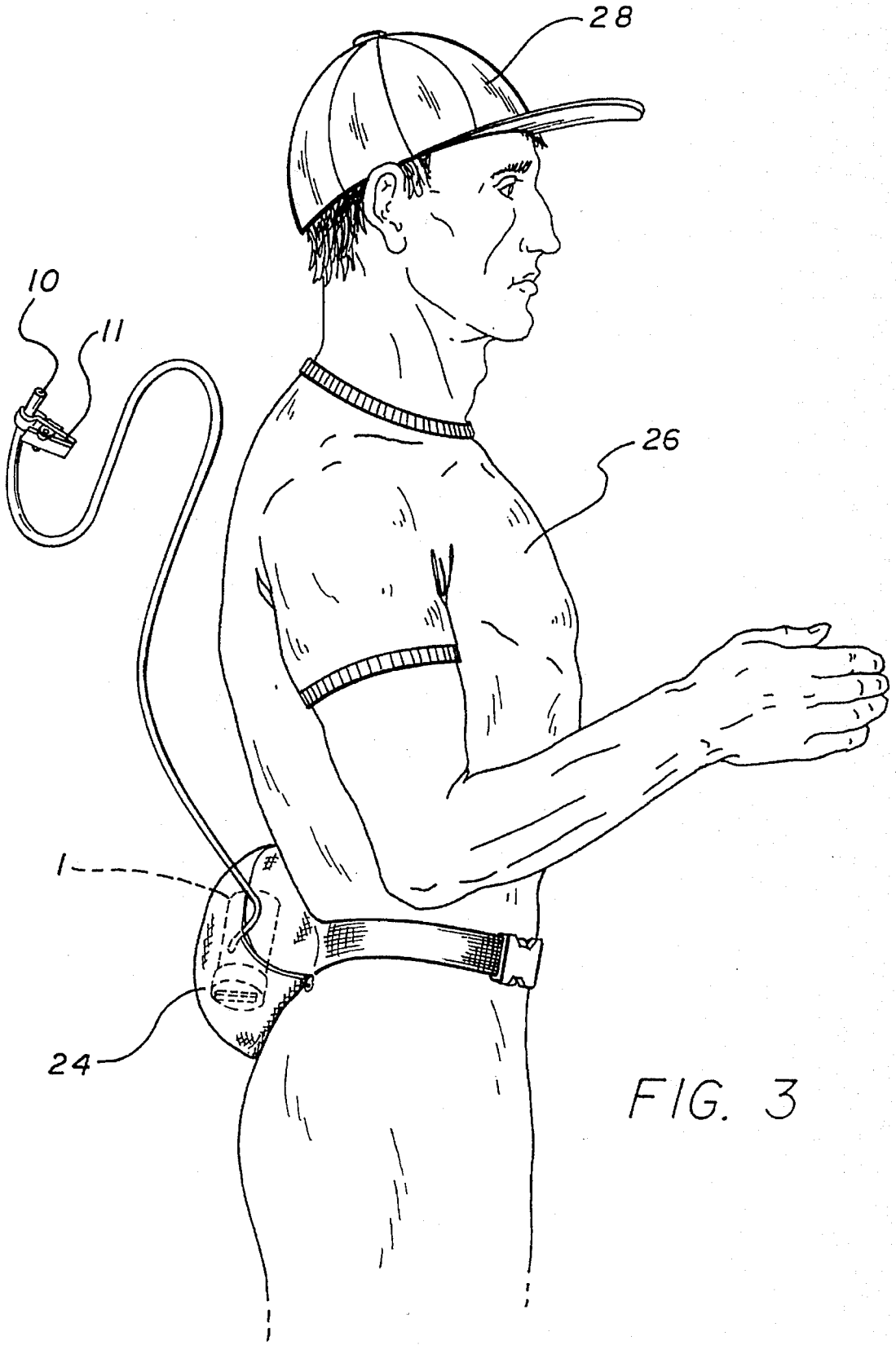
FIG. 3 is a perspective view of a fanny pack style bag containing the misting apparatus of the current invention.

With reference to the accompanying figures, in which like structural and functional features are identified by like reference numerals, there is disclosed the misting apparatus 100 of the present invention. With particular reference to FIG. 1, misting apparatus 100 consists generally of a fluid tank 1, a flow valve 12 connected to a fluid outlet 20 of the tank, and a spray nozzle 10 connected to the flow value 12 by a flexible or rigid tube 8.

Fluid tank 1 defines an inner fluid chamber 13 having a fluid outlet 14. A removable cap 20 in FIG. 2 allows for filling the inner chamber 13 with a fluid and a method for sealing the tank 1. A belt 2 is attached to the tank 1 or in another preferred embodiment the belt is attached or part of a bag housing the entire device. A buckle 3 connected to belt 2 secures the device around a persons waist. A clip 11 is secured around the tube and is of alligator clip style construction for attaching the device to a persons hat or other piece of clothing allowing for hands free operation of the apparatus.

With reference to FIG. 2, pump apparatus 200 is comprised of a threaded cap 20 which creates a seal with the pressurizable tank 1 of FIG. 1 when O-ring 18 is sandwiched between the two. A tubular cyclinder 16 allows the passage of air from outside to the inner chamber 13. Air enters the inner chamber 13 through one way valve 17. A cup seal 15 creates an air tight seal forcing air through tube 16. The cup seal 15 allows air to by pass itself on the up stroke refilling tube 16 with air. A shaft 21 is attached to the cup seal 15 and to pump handle 22 thereby allowing movement of the cup seal 15 when the pump handle 22 is moved.

It will be understood by those skilled in the art, that pressurizaton of inner chamber 13 creates a pressure differential that forces water out through inner-tube 9 and out through outer tube 8 and the spray nozzle when fluid valve 12 is opened.

Referring to FIG. 3, the fluid tank 1 is contained in a fanny pack style bag 24 to allow the apparatus to the secured about the waist of a person 26. The clip 11 may be used to secure the spray nozzle 10 to the person's hat 28 or clothing for hands-free operation of the apparatus.

In accordance with the broad aspects of the present invention, there has been disclosed and described, and hereinafter claimed, a misting apparatus adapted to deliver a spray of fluid and evaporatively cool and or conductively cool a localized area. While the invention has been particularly shown and described in reference to the preferred embodiments thereof, it will be understood by thosee skilled in the art that changes in form and details may be made without departing from the spirit and scope of the invention.

I claim:

1. A misting apparatus comprising:

a pressurizable fluid tank, said fluid tank including means for adding fluid to the fluid tank;

a manual air pump for pressurizing the fluid tank, said manual air pump being removably connectable to said pressurizable fluid tank in sealed fluid communication therewith, said manual air pump having a tubular piston chamber with a one-way valve allowing air to enter said pressurizable fluid tank, a cup seal disposed in said piston chamber and connected to an exterior pump handle;

a flexible tube in fluid communication with the fluid tank, said flexible tube having a distal end and a proximal end, said proximal end connected to said fluid tank;

an alligator clip secured near the distal end of the flexible tube, said clip capable of securing the flexible tube to an article of clothing;

at least one spray nozzle secured at the distal end of the flexible tube, said spray nozzle delivering a fine mist of fluid in the vicinity of a wearer of the clothing when pressurized fluid is communicated to the spray nozzle for cooling the wearer; and a valve connected to said flexible tube between said fluid tank and each said spray nozzle for controlling flow of fluid through said flexible tube.

2. The misting apparatus of claim 1, further comprising:

a valve for controlling fluid flow between the fluid tank and the spray nozzle.

3. The misting apparatus of claim 1, further comprising:

a belt secured to the misting apparatus.

4. The misting apparatus of claim 1, further comprising:

a fanny pack style bag, wherein the fluid tank is positioned within the fanny pack style bag.

5. The misting apparatus of claim 1, wherein the fluid tank contains water.

6. The misting apparatus of claim 5, wherein the fluid tank contains ice.

7. A system for cooling a person, the system comprising:

a pressurizable fluid tank, said fluid tank including means for adding fluid to the fluid tank;

a manual air pump for pressurizing the fluid tank, said manual air pump being removably connectable to said pressurizable fluid tank in sealed fluid communication therewith said manual air pump having a tubular piston chamber with a one-way valve allowing air to enter said pressurizable fluid tank, a cup seal disposed in said piston chamber and connected to an exterior pump handle;

a tube in fluid communication with the fluid tank, said flexible tube having a distal end and a proximal end, said proximal end connected to said fluid tank;

at least one spray nozzle secured at the distal end of the tube, said spray nozzle delivering a fine mist of fluid in the vicinity of the person when pressurized fluid is communicated to the spray nozzle;

means for securing the fluid tank to the person;

an alligator clip securing the tube to an article of clothing worn by the person for delivering the fine mist of fluid in the vicinity of the person for cooling the person; and a valve connected to said tube between said fluid tank and each said spray nozzle for controlling flow of fluid through said flexible tube.

8. The cooling system of claim 6, wherein said securing means comprises a belt secured to the fluid tank.

9. The cooling system of claim 7, wherein said securing means comprises a fanny-pack style bag secured about the waist of the person, said fluid tank positioned in the fanny-pack style bag.

10. The cooling system of claim 7, wherein the clip is secured to the tube at the distal end of the tube.

11. The cooling system of claim 10, wherein the article of clothing to which the clip is secured comprises a hat.

12. The cooling system of claim 7, further comprising:

a valve for controlling fluid flow between the fluid tank and the spray nozzle.

13. The cooling system of claim 12, wherein the fluid tank contains water.

14. The cooling system of claim 13, wherein the fluid tank contains ice.

15. A misting apparatus, comprising:

a pressurizable fluid tank, said fluid tank including means for adding fluid to the fluid tank;

a manual air pump for pressurizing the fluid tank, said manual air pump being removably connectable to said pressurizable fluid tank in sealed fluid communication therewith, said manual air pump having a threaded cap forming a seal for the pressurizable fluid tank, a tubular piston chamber disposed in said pressurizable fluid tank, said tubular piston chamber having a one-way valve allowing air to enter said pressurizable fluid tank, said tubular piston chamber having a cup seal disposed in said piston chamber and connected by a shaft to an exterior pump handle, and said shaft extending through said threaded cap;

a flexible tube in fluid communication with the fluid tank, said flexible tube having a distal end and a proximal end, said proximal end connected to said fluid tank;

at least one spray nozzle secured at the distal end of the flexible tube, said spray nozzle delivering a fine mist of fluid in the vicinity of a wearer of the clothing when pressurized fluid is communicated to the spry nozzle for cooling the wearer; and a valve connected to said flexible tube between said fluid tank and each said spray nozzle for controlling flow of fluid through said flexible tube.

16. A system for cooling a person, the system comprising:

a pressurizable fluid tank, said fluid tank including means for adding fluid to the fluid tank;

a manual air pump for pressurizing the fluid tank, said manual air pump being removably connectable to said pressurizable fluid tank in sealed fluid communication therewith, said manual air pump having a threaded cap forming a seal for the pressurizable fluid tank, a tubular piston chamber disposed in said pressurizable fluid tank, said tubular piston chamber having a one-way valve allowing air to enter said pressurizable fluid tank, said tubular piston chamber having a cup seal disposed in said piston chamber and connected by a shaft to an exterior pump handle, and said shaft extending through said threaded cap;

a tube in fluid communication with the fluid tank, said flexible tube having a distal end and a proximal end, said proximal end connected to said fluid tank;

at least one spray nozzle secured at the distal end of the tube, said spray nozzle delivering a fine mist of fluid in the vicinity of the person when pressurized fluid is communicated to the spray nozzle;

means for securing the fluid tank to the person; and a valve connected to said tube between said fluid tank and each said spray nozzle for controlling flow of fluid through said flexible tube.

* * * * *

UNITED STATES PATENT AND TRADEMARK OFFICE

CERTIFICATE OF CORRECTION

PATENT NO. : 5,620,140

DATED Apr: 15, 1997

INVENTOR(S) : Steven M. Utter

It is certified that error appears in the above-indentified patent and that said Letters Patent is hereby corrected as shown below:

Column 1, line 9, change "deice", to read --device--.

Column 1, line 27, change "area", to read --are a--.

Column 1, line 29, after "crops", add --,--.

Column 1, Line 52, change "prssurize", to --pressurize--.

Column 2, line 4, change "prssurized, to --pressurized--.

Title page, ABSTRACT, 4th line of text, change "he" to read --the--.

Signed and Sealed this

Twenty-third Day of December, 1997

Bruce Lehman

*Attest:*

BRUCE LEHMAN

*Attesting Officer*

*Commissioner of Patents and Trademarks*